United States Patent [19]

Bergvall

[11] Patent Number: 4,458,616

[45] Date of Patent: Jul. 10, 1984

[54] SEMI-AUTOMATIC SEWING MACHINE

[75] Inventor: Bengt A. Bergvall, Huskvarna, Sweden

[73] Assignee: Husqvarna Aktiebolag, Huskvarna, Sweden

[21] Appl. No.: 323,823

[22] Filed: Nov. 23, 1981

[30] Foreign Application Priority Data

Dec. 2, 1980 [SE] Sweden ..... 80084627

[51] Int. Cl.[3] ..... D05B 69/22; D05B 3/02

[52] U.S. Cl. ..... 112/275; 112/158 E

[58] Field of Search ..... 112/275, 277, 158 E, 112/121.11, 121.12

[56] References Cited

U.S. PATENT DOCUMENTS 4,173,193 11/1979 Morinaga et al. ..... 112/275

4,262,614 4/1981 Sugaya et al. ..... 112/158 E

*Primary Examiner*—Peter P. Nerbun

*Attorney, Agent, or Firm*—Alfred E. Miller

[57] ABSTRACT

An electronic sewing machine with a computer (10) for the sewing of a selected fancy seam has electronic circuits to bring about a breaking of a control circuit of the motor (11) of the machine, when the selected seam is completed, and further to detect the "O"-position of a motor control (16) and in this position to re-engage the control circuit and initiate starting codes in the computer for repetition of the selected fancy seam, when the motor is restarted.

6 Claims, 1 Drawing Figure

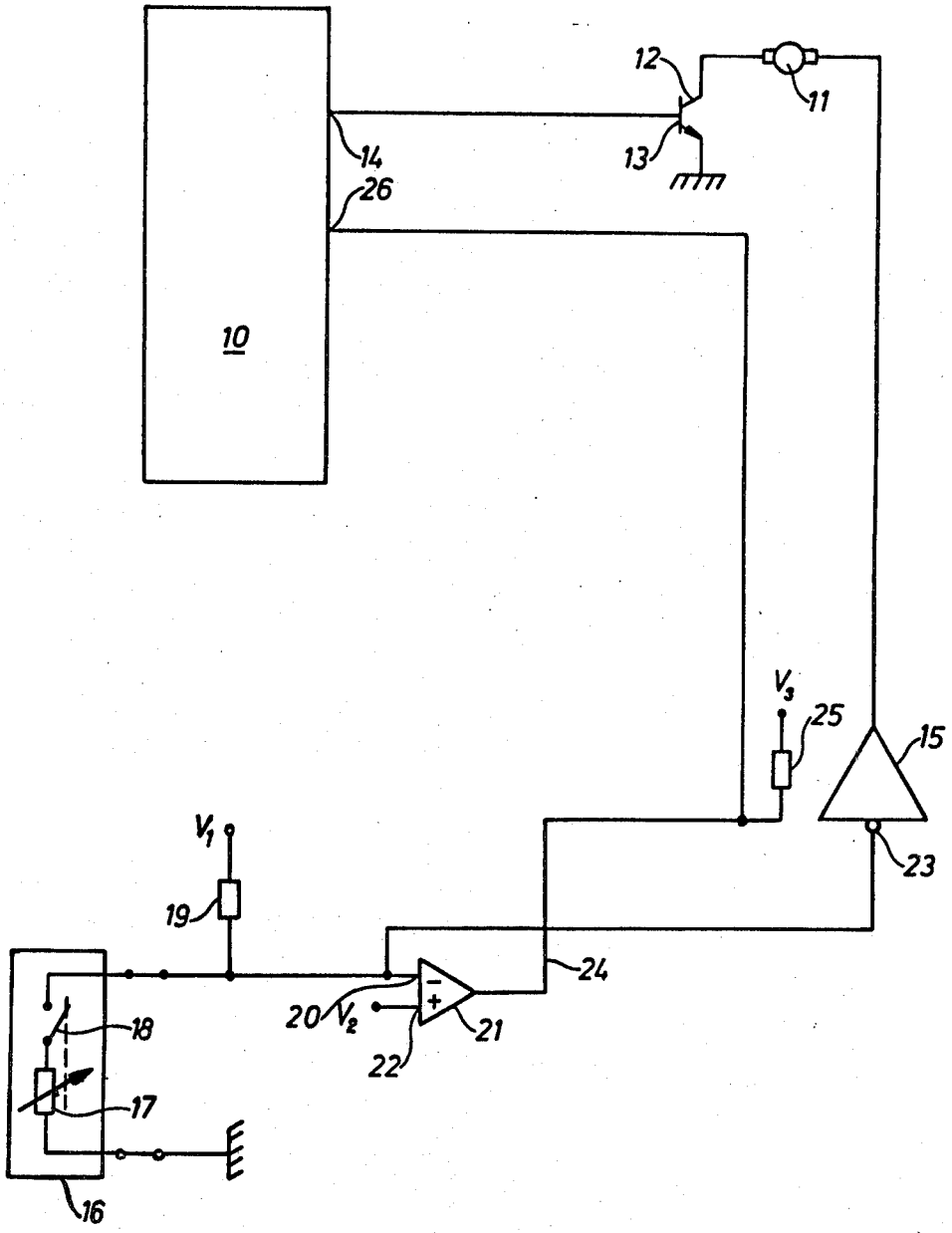
10
11
12
13
14
26
15
23
24
25
$V_3$
$V_1$
19
20
$V_2$
21
22
18
17
16

SEMI-AUTOMATIC SEWING MACHINE

The present invention relates to the automatization of the operation of an electronic sewing machine for domestic use.

In modern, electronic sewing machines having data circuits, circuit means are provided in the electronic system which automatically stop the machine when a seam is completed. This presents too many stitches from being sewn, stopping the machine at a wrong place in a program stopping with the needle in the material or the like. The circuit means can also serve the function of reducing the speed of the machine just before it is about to stop. This gives information to the operator that the seam is finished. When the machine has stopped, it is possible to restart the same program or start another program from the beginning and sew until the machine stops again.

In certain sewing operations, for example the sewing of buttonholes or block letter names the same seam is repeated several times one after the other. Since the programs for the performance of a seam of this type can contain several moments which each require an adjustment, it can be advantageous to let the adjustments and thereby the program remain in the storage and operating circuits which control the stitches. When the machine restarts after a completed seam the program is repeated exactly as it was effected in a former process. This fact ensures that one seam will be exactly like the other and that the risk of differences in the adjustment from time to time is eliminated.

In the present invention circuit means are provided which, under the particular condition that the machine stops automatically when a seam is completed, on restart of the machine make it repeat the pattern for which it is adjusted at that moment. The sewing of a number of identical seams is thereby considerably facilitated since only the current control by which each operation is started, is used.

An embodiment of circuit means according to the invention is described in the following with reference to the attached drawing which shows a wiring diagram of the circuit means.

In an electronic sewing machine equipped with a computer 10, the driving motor 11 of the machine is controlled by a control circuit, including a transistor 12 whose base electrode 13 receives a control current from an output 14 of the computer. There is a control circuit in this computer which delivers a current to the base electrode 13 in response to certain settings of the machine and the sewing can be started. Without these settings no control current will be delivered so that the transistor keeps the motor circuit broken. When the sewing is completed according to the setting the control current is cut off and the machine stops. The control circuit also includes a device for the regulation of the speed of the motor. An amplifier 15 supplies the motor in dependence on a second control circuit in which a control means is included, for example a pedal 16, which controls a potentiometer 17 which thereby changes resistance depending on the position of the pedal. A switch 18 in series with the potentiometer is acted on by the pedal to a closing position at the upper position of the pedal. The operating voltage of the control circuit is a low voltage $V_1$ which is supplied via a resistor 19 to an input 20 of a comparator 21. The second input 22 of the comparator is connected to a second low voltage $V_2$ which is somewhat lower than $V_1$ and also supplies a control input 23 of the amplifier 15. The voltage of these inputs is controlled by the potentiometer with one grounded end. The amplifier 15 has an inverted amplifying function so that a lowering of the control voltage results in a rise of the output voltage applied to the motor.

The voltage of the input 20 is reduced when the pedal is pressed down and will thereby be lower than the voltage $V_2$ of the input 22. The comparator has the same function as a differential relay which, in response to a higher voltage on 20, closes one contact but at a higher voltage on 22 closes another contact. However, in the present case the circuit is electronic, for example the well-known standard module LM 339. A signal on an output wire 24 can thereby be produced by means of a low voltage $V_3$ and a resistor 25 dependent on the highest voltage on the inputs 20 and 22 respectively. The signal in the form of a logic "0" or "1" comes about at the grounding and the non-grounding, respectively, of the wire 24 in the comparator and is fed to an input 26 of the computer. The signal is "0" when the pedal 16 is in the upper position and "1" when it is pressed down.

A logic circuit in the computer reads the signal on the input 26 and when a logic "0" arrives on this input (pedal up) a re-establishment of the control current is effected on the base electrode 13 so that the motor can be restarted. Further the circuit releases or passes a signal to a register or the like in the computer wherefrom a starting code for the selected pattern is given. Such a starting code is then in a known way followed by successively fed codes for the sewing of a seam. The operation for sewing seams by means of data has been described previously in a great number of patent publications and need not be described further. When the seam is completed the computer again breaks the control current to the transistor 12 and the machine stops. It should be noted that the control current is re-established also when another setting of a fancy seam is made on the machine.

I claim:

1. In a semi-automatic sewing machine having a computer and stitch-forming elements for sewing at least one fancy seam and repeating the sewing of said seam an arbitrary number of times, said stitch forming elements being controlled by stitch codes initiated by said computer, and a motor control with circuit means including coupling means for disconnecting the motor when such a fancy seam is completed; the improvement wherein the circuit means are connected to sense an end position of the motor control and in response thereto to reengage the motor and initiate further starting codes for the fancy seam in the computer, and thereby successively feed stitch codes to a control means of the stitch-forming elements upon the restarting of the motor by means of the motor control.

2. The sewing machine of claim 1 wherein the motor control is provided with a switch connected to break a signal circuit in said end position so that instruction is given to the computer to execute said reengagement and initiation of starting codes.

3. The sewing machine of claim 2 wherein an amplifying circuit with a comparator is connected between the switch and the computer.

4. In a semi-automatic sewing machine including computer means, stitch forming means for sewing fancy seams in response to stitch codes initiated by said computer means, a motor, and a control circuit coupled to said computer means for controlling said motor; the improvement wherein said circuit means comprise first switch means connected to said computer for enabling energization and deenergization of said motor, operator controllable second switch means connected to control said motor, and means for sensing a determined position of said second switch means, said computer means being responsive to said sensing means when said motor is deenergized for reenergizing said motor and initiating a sequence of stitch codes to said stitch elements whereby the stitch forming means sews another of said fancy seams in accordance with the current stitch codes.

5. The sewing machine of claim 4 wherein said second switch means comprises an operator controllable pedal including a potentiometer for varying current applied to said motor and a switch that is opened in one end position of said second switch means.

6. The sewing macine of claim 5 wherein said sensing means comprises comparator means coupled to said second switch means for sensing the open position of said second switch means.

* * * * *